United States Patent [19]

Knapp et al.

[11] 4,403,739

[45] Sep. 13, 1983

[54] DEVICE FOR AERATING A JET OF WATER

[76] Inventors: Francesco Knapp, 17, via Ferrini, Pavia, Italy; Alfons Knapp, Bleicherstrasse 3, Biberach an der Riss, Fed. Rep. of Germany

[21] Appl. No.: 323,588

[22] Filed: Nov. 20, 1981

[30] Foreign Application Priority Data

Jan. 15, 1981 [IT] Italy ..... 67035 A/1981

[51] Int. Cl.[3] ..... E03C 1/084

[52] U.S. Cl. ..... 239/428.5

[58] Field of Search ..... 239/428.5, 446, 447, 239/590.3, 443, 462, 463

[56] References Cited

U.S. PATENT DOCUMENTS

| | | | |
|---|---|---|---|
| 968,462 | 8/1910 | Glazier | 239/590.3 |
| 2,797,906 | 7/1957 | Aghnides | 239/590.3 |
| 2,989,249 | 6/1961 | Richter . | |
| 2,998,929 | 10/1961 | Aghnides | 239/428.5 |
| 3,432,105 | 3/1969 | Delamater | 239/562 |
| 3,672,574 | 6/1972 | Knapp . | |
| 4,119,275 | 10/1978 | Hunter | 239/562 |

FOREIGN PATENT DOCUMENTS

| | | |
|---|---|---|
| 867080 | 2/1953 | Fed. Rep. of Germany |
| 1107607 | 5/1961 | Fed. Rep. of Germany |
| 2012606 | 9/1970 | Fed. Rep. of Germany |
| 1202190 | 1/1960 | France |
| 847510 | 9/1960 | United Kingdom |

*Primary Examiner*—John J. Love
*Assistant Examiner*—Jon M. Rastello
*Attorney, Agent, or Firm*—Young & Thompson

[57] ABSTRACT

A device for aerating a jet of water, particularly for the delivery spout of a hydraulic apparatus, with a mixing chamber, an air intake, a delivery orifice provided with nets for regularization of the jet, and a pulverization device comprising a first and a second element having each at least a ring series of openings of relatively large size, these two elements, when in the position of finer pulverization, being superimposed in such a way that the openings of the two elements register with each other along small portions adjacent to the edges, thus forming a plurality of restricted passages. Perferably, the opposite edges of each opening of one element form two narrow passages with the adjacent edges of two subsequent openings of the other element, thus producing slanting jets which meet the one another and thereby pulverize. The second element may be displaced, interchanged or omitted in order to obtain different working conditions.

7 Claims, 6 Drawing Figures

DEVICE FOR AERATING A JET OF WATER

BACKGROUND OF THE INVENTION

The present invention relates to a device for aerating a jet of water, comprising water pulverization means, an air intake, a mixing chamber and a delivery orifice provided with jet regularizing nets.

Such aerating devices are widely used particularly on spouts of wash basins, wash bowls and bath tubs, in order to obtain a regular jet having little tendency to give rise to sprinklings and in order to reduce the noise of the faucet. However, these devices give rise to various problems, particularly in that an efficient pulverization is generally obtained by causing the jet to pass through a number of very small holes disposed in face of walls which, when being hit by fine partial jets, pulverize the same. The machining of very small holes is rather unsuitable for a mass-production, and on the other hand it is not possible to increase the diameter of the holes without jeopardizing both the pulverization efficiency and the noiselessness of the device. In addition, the presence of very small holes traversed by the flow of water rapidly leads to a clogging of the holes and, hence, to the necessity of replacing the device, it being practically impossible to efficiently clean the clogged holes.

It is also known (Knapp, U.S. Pat. No. 3,672,574) to cause a number of jets of water to converge, which, hitting each other in a central position, efficiently pulverize each other. However, in this case, the pulverization carried out in a single central position is disadvantageous in that it makes necessary the use of a ball or a similar body, which has the function of stabilizing the jet and which, moreover, by Venturi effect, produces the suction of air for the aeration.

BRIEF SUMMARY OF THE INVENTION

The main object of this invention is to provide an aerating device of simple and economical manufacture, which is free from the disadvantages of the known aerators, or shows the same to a smaller extent, and which in particular does not require the provision of very small holes and nevertheless ensures an efficient pulverization and aeration of the jet, when no stabilizing ball or the like is used.

An auxiliary object of the invention is to provide an aerating device which can be easily adapted for being used on hydraulic apparatuses of very different flow rates, such as the spouts of wash basins, wash bowls and bath tubs.

The main object of this invention is achieved by a device for aerating a jet of water, comprising a water pulverization device, an air intake, a mixing chamber and a delivery orifice provided with jet regularization means, wherein the pulverization device comprises a first element having at least one ring series of openings of relatively large size, and a second element, also having a ring series of relatively large openings, superimposed on the first element in such a manner that the openings of the two elements register with each other only along short portions adjacent the edges, thus forming a plurality of restricted passages.

In this way it is possible to obtain very narrow passages, arranged to efficiently pulverize the jet and to reduce the noise, though being the elements of the device provided with openings which are relatively large and hence easy to be manufactured. Moreover, the possible cloggings may easily be eliminated by separating the two elements which may then be efficiently cleaned.

Furthermore, the construction of the pulverization device by means of two elements allows achieving also the auxiliary object of the invention, which may be attained either by providing a plurality of second elements suitable of being superimposed on the first element of the pulverization device and having different characteristics, or by providing the possibility of superimposing the second element on the first in different positions, or even, in certain cases, by simply omitting assembling the second element.

Preferably, the openings of the two superimposed elements are arranged in such a way that the opposite edges of each opening of an element form narrow passages with the contiguous edges of two subsequent openings of the other element. By virtue of this arrangement, each passage produces a small slanting jet which converges towards the jet, slanting in the opposite direction, of the contiguous passage, so that the two jets meet one another and pulverize without requiring the presence of a wall. This arrangement ensures a high efficiency of the pulverization and further reduces the noise. Since the pulverization by reciprocal hitting of jets takes place, in this case, at a number of points arranged along a ring, the air may freely penetrate between the various jets and is then entrained by the pulverized flow, even if no use is made of any stabilizing ball or similar body suitable to produce a suction by Venturi effect.

BRIEF DESCRIPTION OF THE DRAWING

These and other features and advantages of the invention will more clearly appear from the following description of an embodiment given by way of non limiting example and diagrammatically shown in the accompanying drawing, in which.

DETAILED DESCRIPTION OF A PREFERRED EMBODIMENT

Figure 3:
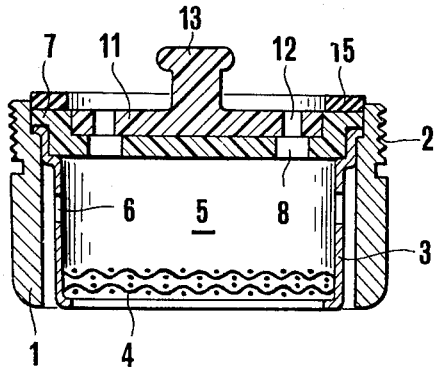
FIG. 3 shows the aerator in a vertical section taken along line III—III of FIG. 2.

In the embodiment of the invention, shown in the drawing, reference numeral 1 indicates the body of the aerator, formed by a sleeve which terminates in the upper portion with a screw thread 2 for the assembly into the end of a delivery spout of a hydraulic apparatus. Mounted in the sleeve 1 is a cylinder 3, whose lower end defines a delivery opening provided with nets 4 for regularizing the jet; above the nets 4 a mixing chamber 5 is formed, to which the ambient air may arrive through openings 6 formed in the wall of the cylinder 3 and through the gap defined between the cylinder 3 and the sleeve 1. The parts described till now are common to the most part of the aerators and do not require to be modified for being used with the present invention; they may therefore be of any kind and shape.

The mixing chamber 5 is closed in the upper part by a first element 7 having substantially the shape of a disc provided with a ring series of openings 8, which in this case are formed by circular holes regularly spaced along a single circle. The holes 8 have a diameter large enough to allow the element 7 to be easily manufactured for example by moulding it from plastics. Furthermore, the disc 7 preferably forms a cavity for accomodating therein the second element of the pulverization device, to be described hereunder.

Figure 1:
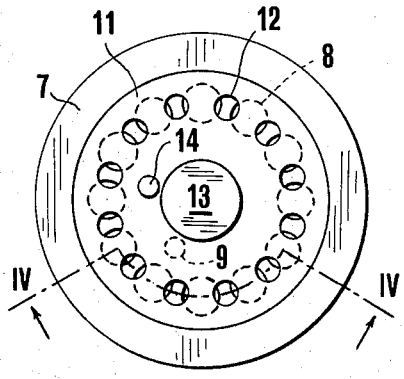
FIG. 1 is a plan view showing the aerator in the condition of maximal pulverization.

The second element of the pulverization device, on its turn, is formed by a disc 11, also provided with a ring series of openings 12, formed in this case by circular holes, whose number is equal to that of the holes 8 of the first element 7 and which are disposed along a circle of the same diameter. The holes 12 also have a diameter large enough to allow element 11 to be easily manufactured, for example by moulding it from plastics; moreover, in the shown embodiment, the holes 12 are smaller than the holes 8. The diameters of the holes 8 and 12, the diameter of the circle along which they are disposed and their number are chosen in such a way that, when the two discs 7 and 11 are superimposed on one another with the respective holes 8 and 12 offset, as shown in FIG. 1, the opposite edges of each hole of one element form narrow passages with the contiguous edges of two subsequent holes of the other element. In this way, the passages obtained can be as narrow as it may be desired, even by starting from holes having a considerable diameter. The formed passages are twice in number than the holes of each element and may be adapted to the most severe requirements of an aerator for small flow rate, for example for wash basins, where the aeration and noiselessness requirements are the most rigorous.

Figure 6:
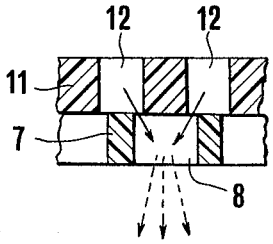
FIG. 6 is an enlarged view of a detail of the section according to FIG. 4.

As it can be seen particularly from the diagram of FIG. 6, owing to the arrangement of the edges of the offset holes 8 and 12, which define the passages, these latter are traversed by slanting and convergent flows (solid line arrows) which hit one another and pulverize by giving rise to a flow of finely atomized water (dashed line arrows) which, within the mixing chamber 5, is efficiently mixed with air, thus forming an aerated jet, which is then regularized by the nets 4.

Figure 2:
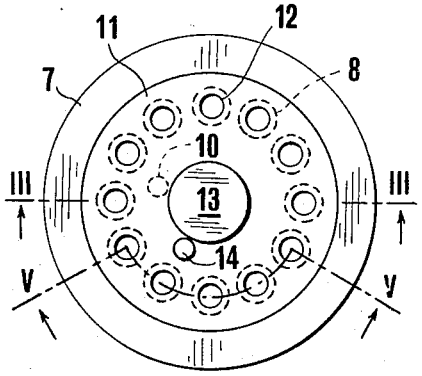
FIG. 2 is a similar view of the aerator, but in a condition of reduced pulverization.
Figure 4:
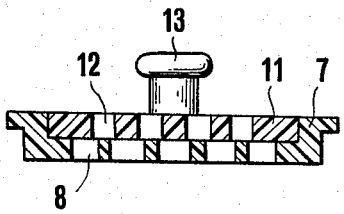
FIGS. 4 and 5 show the development of sections taken along lines IV—IV and V—V, respectively of FIGS. 1 and 2.
Figure 5:
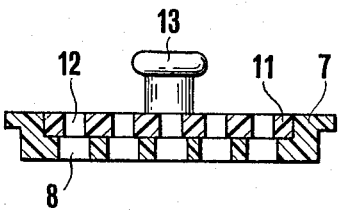

There is, however, the possibility for the disc 11 to be superimposed on the disc 7 with the holes 12 and 8 aligned, instead of being offset, as shown in FIGS. 2 and 5. In this case, the pulverization is reduced to that caused by the subdivision of the jet by the holes 12, whilst the holes 8 of larger diameter remain inactive; the device is instead adapted for a much larger delivery. This arrangement may thus be utilized for using the same aerator, which in the configuration shown in FIGS. 1 and 4 is suitable for a small delivery, as for example in a wash basin, in applications requiring a larger delivery, as for example in a kitchen wash bowl. To facilitate arranging the disc 11 in one of the correct positions with respect to the disc 7, the disc 11 has a grasping 13 and is provided with a centering pin 14 which may be inserted in either one of two corresponding holes 9 and 10 formed in the disc 7 (FIGS. 1 and 2). Of course, this arrangement given by way of example could be replaced by a non circular configuration of the elements 7 and 11, or by other mutual reference means anyhow disposed.

Of course, it is possible to provide discs 11 of different characteristics, interchangeable on the same aerating device in order to adapt the latter to different requirements. Moreover, the device may be adapted for even higher capacities, with consequent lesser pulverization, by simply omitting mounting the element 11 and allowing only the holes 8 of the element 7 to carry out their function.

Although circular holes 8 and 12 have been illustrated, it is to be understood that they may be replaced by openings of any other shape, for example rectangular; however, the circular configuration of the holes gives rise, with their mutual intersection, to narrow passages biangular in shape, particularly efficient for this application.

In particular cases, in which the separability of the elements 7 and 11 forming the pulverization device is not required, these elements may be definitively fixed the one another during the manufacture, and in this case the mutual references 9, 10 and 14, as well as the grasping projection 13, may even be omitted.

Usually, a sealing gasket 15 is superimposed on the device described hereinabove, in view of its assembly without leaks in a delivery spout.

Various constructional modifications may be made in the parts described hereinabove, which may also be substituted by technically equivalent means, without departing from the scope of the invention.

We claim:

1. A device for aerating a jet of water, comprising a substantially cylindrical wall defining an inner mixing chamber and a bottom delivery orifice, air intake openings traversing said cylindrical wall, means for jet regularization arranged within said delivery orifice, and at the upper end of said cylindrical wall a pulverization device comprising a first element having at least one ring series of openings and a second element also having at least one ring series of openings, said second element being superimposed onto said first element with the openings of said second element in register with the openings of said first element only along short portions adjacent the edges of the openings, whereby the openings of said first and second element together form restricted passages for water, whose cross section is substantially lesser than the cross section of the openings themselves, said restricted passages being formed between the opposite edges of each opening of each element and the contiguous edges of two subsequent openings of the other element, whereby each pair of subsequent restricted passages generates two small water jets slanting the one towards the other.

2. A device for aerating a jet of water as set forth in claim 1, wherein said second element of the pulverization device is suitable for being mounted onto said first element in at least two different positions corresponding to different working conditions.

3. A device for aerating a jet of water as set forth in claim 2, wherein said first and second elements of the pulverization device have mutual positioning means intended to define the different mounting positions of said second element.

4. A device for aerating a jet of water as set forth in claim 3, wherein said mutual positioning means comprise at least one centering pin on one element and at least two holes in the other element.

5. A device for aerating a jet of water as set forth in claim 1, wherein the openings of said second element of the pulverization device are smaller than the openings of the first element.

6. A device for aerating a jet of water as set forth in claim 1, wherein the openings of said first and second elements of the pulverization device have the shape of circular holes, whereby the passages defined by the openings of both elements together are biangular in shape.

7. A device for aerating a jet of water as set forth in claim 1, wherein both elements of the pulverization device are moulded from plastics.

* * * * *